US008220202B2

(12) United States Patent
Riley et al.

(10) Patent No.: US 8,220,202 B2
(45) Date of Patent: Jul. 17, 2012

(54) HINGE PIN MOUNTED DOOR SWITCH

(76) Inventors: James W Riley, Fairport, NY (US); Steve Markham, Rochester, NY (US)

( * ) Notice: Subject to any disclaimer, the term of this patent is extended or adjusted under 35 U.S.C. 154(b) by 788 days.

(21) Appl. No.: 12/270,232

(22) Filed: Nov. 13, 2008

(65) Prior Publication Data

US 2010/0115844 A1 May 13, 2010

(51) Int. Cl.
*H01H 3/16* (2006.01)

(52) U.S. Cl. ..... 49/13; 49/14; 16/223

(58) Field of Classification Search ..... 49/13, 14, 49/381; 16/223

See application file for complete search history.

(56) References Cited

U.S. PATENT DOCUMENTS 426,705 A * 4/1890 Bleakley ..... 200/61.7
499,428 A * 6/1893 Hull ..... 200/61.7
615,209 A * 11/1898 Baxter ..... 439/31
978,849 A * 12/1910 Collier ..... 200/61.7
3,076,163 A 1/1963 Nodge
3,729,603 A * 4/1973 Foltz ..... 200/61.7
3,840,715 A * 10/1974 Gwozdz ..... 200/61.7
3,857,625 A * 12/1974 Crane et al. ..... 439/31
3,896,404 A * 7/1975 Peterson ..... 335/205
4,049,934 A * 9/1977 Newlon ..... 200/61.7
4,066,857 A 1/1978 Suska
4,072,917 A 2/1978 Haag et al.
4,116,514 A 9/1978 Lawrence
4,148,001 A * 4/1979 Gwozdz ..... 335/205
4,150,265 A 4/1979 Holden
4,168,409 A 9/1979 McNinch
4,211,990 A * 7/1980 Gwozdz ..... 335/205
RE30,716 E * 8/1981 Suska ..... 200/61.7
4,284,861 A 8/1981 Senften
4,412,711 A 11/1983 Suska
4,839,939 A 6/1989 O'Brien, II
4,841,283 A * 6/1989 Bubliewicz ..... 340/545.3
4,922,064 A 5/1990 Price et al.
5,267,866 A 12/1993 Swift et al.
5,488,209 A 1/1996 Orrico et al.
5,651,536 A * 7/1997 Daul ..... 267/205
5,717,380 A 2/1998 Zehrung
6,548,774 B1 4/2003 Bachle
6,577,235 B2 * 6/2003 Frys ..... 340/547
6,667,449 B2 12/2003 Wecke et al.
6,724,285 B1 * 4/2004 Zehrung ..... 335/205
7,238,900 B2 7/2007 Ulfik et al.
7,271,358 B2 9/2007 Ulfik et al.
2002/0125116 A1 * 9/2002 Wecke et al. ..... 200/61.7

* cited by examiner

*Primary Examiner* — Katherine W Mitchell
*Assistant Examiner* — Justin Rephann
(74) *Attorney, Agent, or Firm* — Taft Stettinius & Hollister, LLP; Keith Swedo, Esq.

(57) ABSTRACT

A method for detecting a position of a door includes providing a switch having a body with two electrical contacts and a through-channel. Two lever arms extend from the body. Each of the arms is attached to a respective one of the electrical contacts. The arms have a first position relative to each other wherein the contacts are electrically connected to each other, and a second position relative to each other wherein the contacts are electrically disconnected from each other. A hinge pin is inserted through the through-channel of the switch and is also inserted into a door hinge. The arms are biased against a doorjamb and the door, respectively. It is monitored whether the contacts are electrically connected to each other.

14 Claims, 8 Drawing Sheets

HINGE PIN MOUNTED DOOR SWITCH

BACKGROUND

1. Field of the Invention

The present invention relates to apparatuses and methods for detecting a position of a door.

2. Description of the Related Art

Known approaches to monitoring whether a door is open or closed employ a two part magnetic switch or a button type switch, which requires a very intrusive mounting scheme. This mounting scheme involves drilling into the door jamb and the door itself, which is time consuming for an installer and destructive to the door and the door jamb.

Another known configuration uses a flush mounted two part magnetic switch. However, this configuration does not work well with door/jamb configurations in which there is inadequate flush mounting surface between the door and the jamb.

Yet other known configurations employ mechanical switches that are integral to the hinge itself. These solutions have very detailed and elaborate machining and design aspects involving specific hinge designs.

All current solutions for monitoring door open states require switches that are mounted by a combination of drilling and screwing, which is destructive and time consuming for the installer. Thus, problems associated with known door position sensors include having to replace existing door hinges; high manufacturing costs; excessive installation time; and the fact that the sensors are not universal solutions that apply to most door installations and types.

What is neither disclosed nor suggested by the prior art is a door position detecting arrangement that requires no drilling or screwing in order to mount and install the apparatus.

SUMMARY

The present invention provides security systems that require low cost and easy to install door contacts to monitor door states for entry and exit doors as well as interior door monitoring. A mechanical switch is mounted by removing a hinge pin from a door that is to be monitored. The pin is inserted through the switch and then into the hinge. The switch includes two lever arms that are respectively spring-biased against the door jamb and against the door surface that faces the doorjamb when the door is closed. As the door opens, the lever arms move apart, which causes internal metallic contacts of the switch to slide out of contact with each other. The switch housing encloses the metallic contacts and wires connected thereto. The switch housing has upper and lower halves which are attached to and move with respective ones of the lever arms. A center sleeve may prevent pinching of the hinge pin on the switch housing and may prevent damage to the switch resulting from the force of the hinge pin being reinstalled.

The mechanical hinge pin mounted switch of the present invention may be mounted by removing a hinge pin from a residential or commercial door where the position of the door will be monitored. The pin is inserted through the switch and then placed back in the hinge. The displacement of the pin within the hinge may be minimal and may have no effect on the mechanical strength or operation of the hinge. The lever arms of the switch may be spring loaded so that there is no requirement for using any screws for mounting the switch.

The switch of the present invention may meet all of the criteria for being tamper-proof. The actual switch contacts and wires may be located in a secure area. The switch can be mounted on any one of the door hinges, thereby increasing the difficulty for an intruder to access the lever arms and bypass the switch's operation.

In one aspect, the present invention includes a method for detecting a position of a door. A switch is provided having a body with two electrical contacts and a through-channel. Two lever arms extend from the body. Each of the arms is attached to a respective one of the electrical contacts. The arms have a first position relative to each other wherein the contacts are electrically connected to each other, and a second position relative to each other wherein the contacts are electrically disconnected from each other. A hinge pin is inserted through the through-channel of the switch and is also inserted into a door hinge. The arms are biased against a door jamb and the door, respectively. It is monitored whether the contacts are electrically connected to each other.

In another aspect of the present invention, a door position sensing arrangement includes a door hinge having a fixed part and a rotatable part. The fixed part is attached to a door frame and the rotatable part is attached to a door. The fixed part and the rotatable part conjunctively define a first through-channel. A switch includes a fixed portion and a rotatable portion rotatably coupled to the fixed portion. The fixed portion has a first electrical contact and the rotatable portion has a second electrical contact. The fixed portion is biased against the fixed part of the door hinge and/or the door frame. The rotatable portion is biased against the rotatable part of the door hinge and/or the door. The fixed portion and the rotatable portion conjunctively define a second through-channel aligned with the first through-channel. The fixed portion and the rotatable portion have a first position relative to each other wherein the contacts are electrically connected to each other, and a second position relative to each other wherein the contacts are electrically disconnected from each other. A hinge pin extends at least partially through the second through-channel of the switch and at least partially through the first through-channel of the hinge.

In still another aspect, the present invention provides a door position sensing arrangement including a door hinge having a fixed part and a rotatable part. The fixed part is attached to a door frame and the rotatable part is attached to a door. The fixed part and the rotatable part conjunctively define a first through-channel. A switch includes a fixed portion and a rotatable portion rotatably coupled to the fixed portion. The fixed portion is biased against the fixed part of the door hinge and/or the door frame. The rotatable portion is biased against the rotatable part of the door hinge and/or the door. The fixed portion and the rotatable portion conjunctively define a second through-channel aligned with the first through-channel. Means are provided for sensing a position of the rotatable portion of the switch relative to the fixed portion of the switch. A hinge pin extends at least partially through the second through-channel of the switch and at least partially through the first through-channel of the hinge.

An advantage of the present invention is that it has minimal installation requirements.

Another advantage is that the present invention is simple and inexpensive to manufacture, with a high level of reliability due to its simplicity.

Yet another advantage is that the apparatus of the present invention may require only the existing door hinge and hinge pin as a mounting mechanism.

A further advantage is that the present invention is operable with both wooden and metallic doors since the electrical contacts in the switch are not susceptible to magnetic interference issues.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1A:
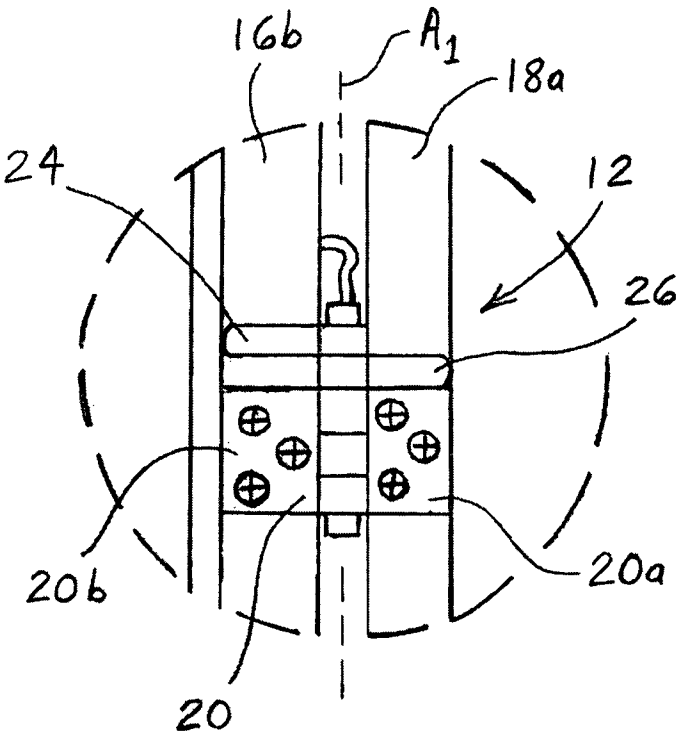
FIG. 1A is a enlarged view of the encircled region 1A in FIG. 1.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Figure 1:
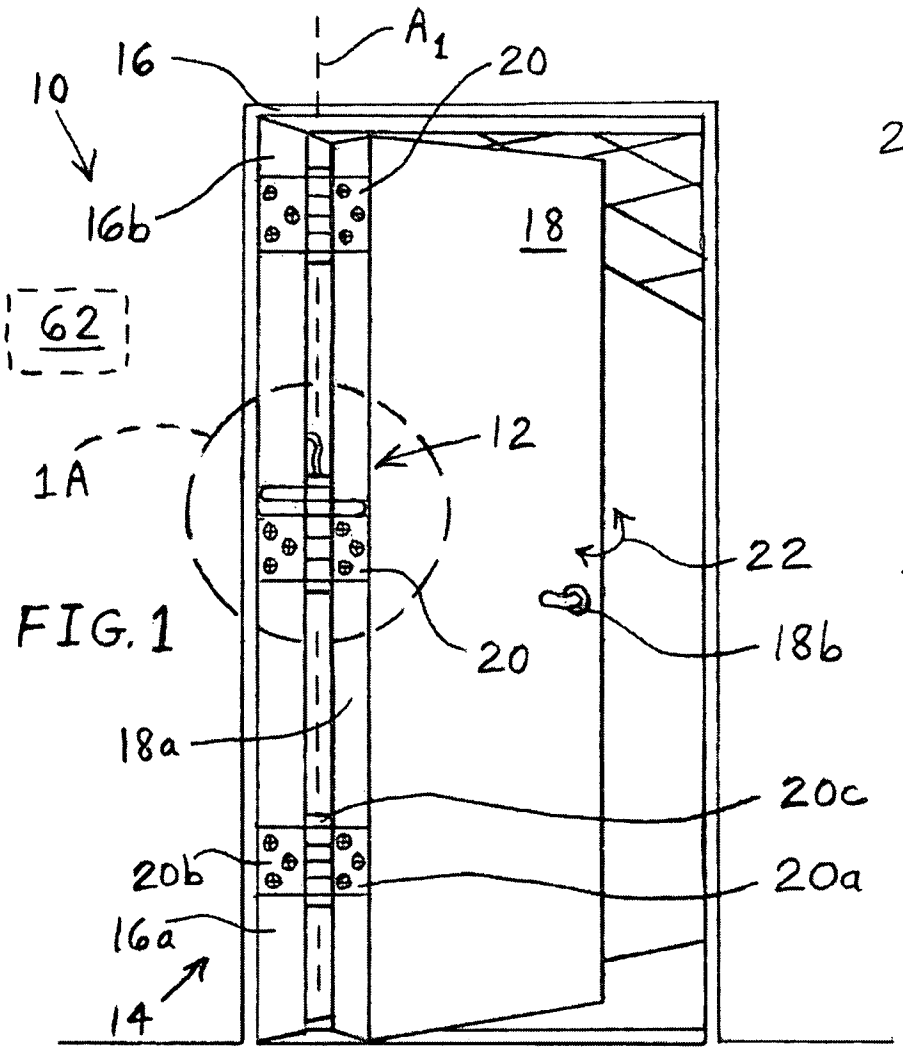
FIG. 1 is a front view of a door position sensing arrangement with the door in an open position and equipped with a door position detection switch in accordance with one embodiment of the present invention.

Referring first to FIGS. 1 and 1A, a door position sensing arrangement 10 in accordance with one embodiment of the present invention is illustrated. Door position sensing arrangement 10 includes a door position detection switch 12 which is operably mounted on a door assembly 14. Door assembly 14 generally includes a door frame 16 and a door 18, which is pivotably mounted to door frame 16 by hinges 20. Door 18 includes, among other things, frame-facing edge surface 18*a* to which hinges 20 are coupled, and door handle 18*b*. Door frame 16 includes, among other things, jamb 16*a*, which includes door-facing edge surface 16*b*. Each hinge 20 includes a door mounting plate 20*a*, which is mounted to frame-facing edge surface 18*a* of door 18, and frame mounting plate 20*b*, which is mounted to door-facing edge surface 16*b* of frame 16, such as by screws. Door mounting plate 20*a* and frame mounting plate 20*b* are pivotably coupled to one another by pin 20*c*. Door 18 is pivotable relative to frame 16 and about axis Al, as indicated by double arrow 22. More particularly, door 18 is pivotable between an open position, shown in FIG. 1, wherein frame-facing edge surface 18*a* is spaced apart from door-facing edge surface 16*b*, and a closed position, shown in FIG. 2, wherein frame-facing edge surface 18*a* may be aligned proximal to and parallel with door-facing edge surface 16*b*. Door 18 pivots in a first direction when moving from the closed position to the open position, and door 18 pivots in an opposite second direction when moving from the open position to the closed position.

Referring still to FIGS. 1 and 1A, door position detection switch 12 generally includes a fixed or stationary portion 24 and a rotatable portion 26. Rotatable portion 26 is in rotatable engagement with stationary portion 24 such that rotatable portion 26 may rotate relative to stationary portion 24 about axis $A_1$.

Figure 3:
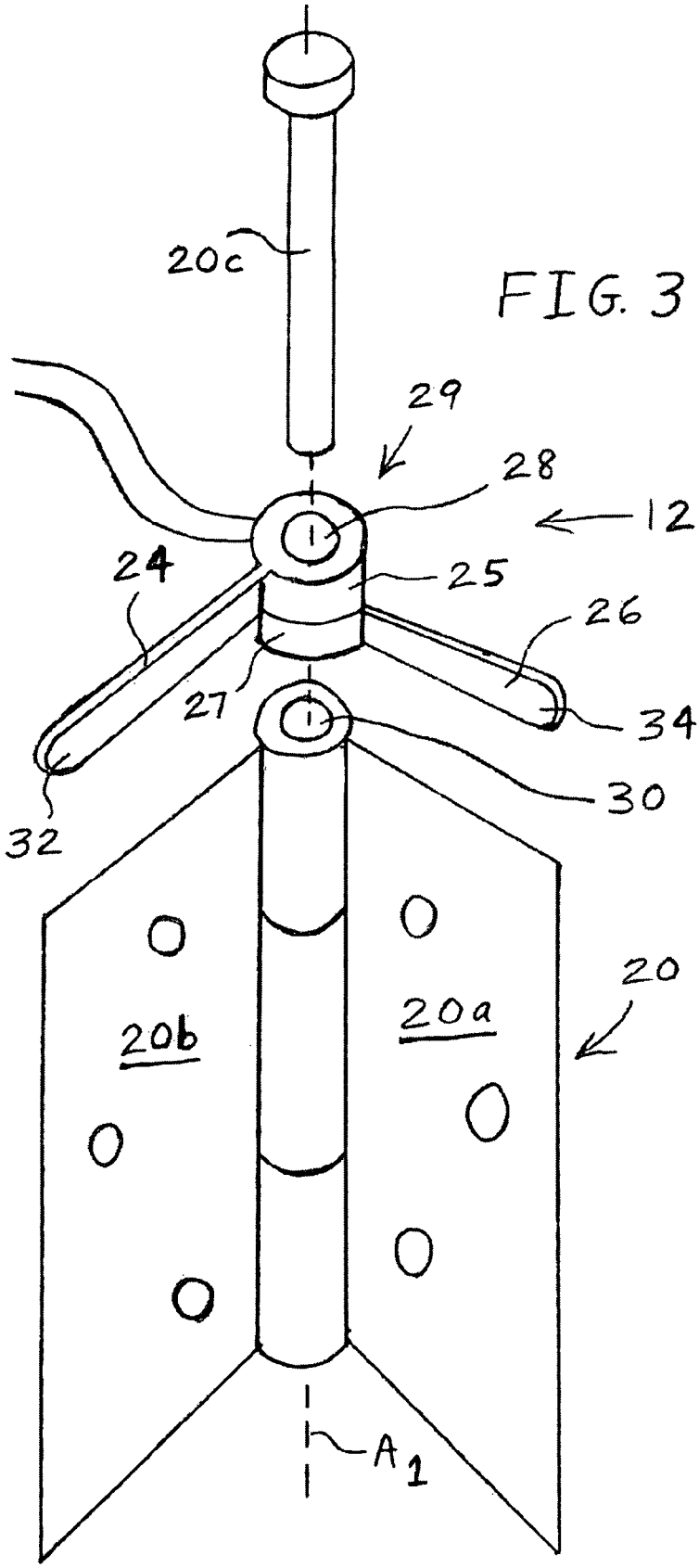
FIG. 3 is an exploded perspective view of the door position detection switch, door hinge, and hinge pin in FIG. 1.

Stationary portion 24 includes a body 25 (FIG. 3) having a lever arm 32 extending laterally therefrom, and rotatable portion 26 includes a body 27 having a lever arm 34 extending laterally therefrom. Bodies 25, 27 conjunctively form a body 29 of switch 12 and define a through-channel 28 which is aligned with a through-channel 30 of hinge 20 when door position sensing arrangement 10 is in the assembled state illustrated in FIGS. 1 and 1A. Further, hinge pin 20*c* extends through through-channel 28 and extends at least partially through through-channel 30 when door position sensing arrangement 10 is in the assembled state. Switch 12 may be coupled to hinge 20 by only hinge pin 20*c*. That is, switch 12 may not be connected or linked to hinge 20 other than by hinge pin 20*c*, although switch 12 may rest upon or engage hinge 20.

Figure 4A:
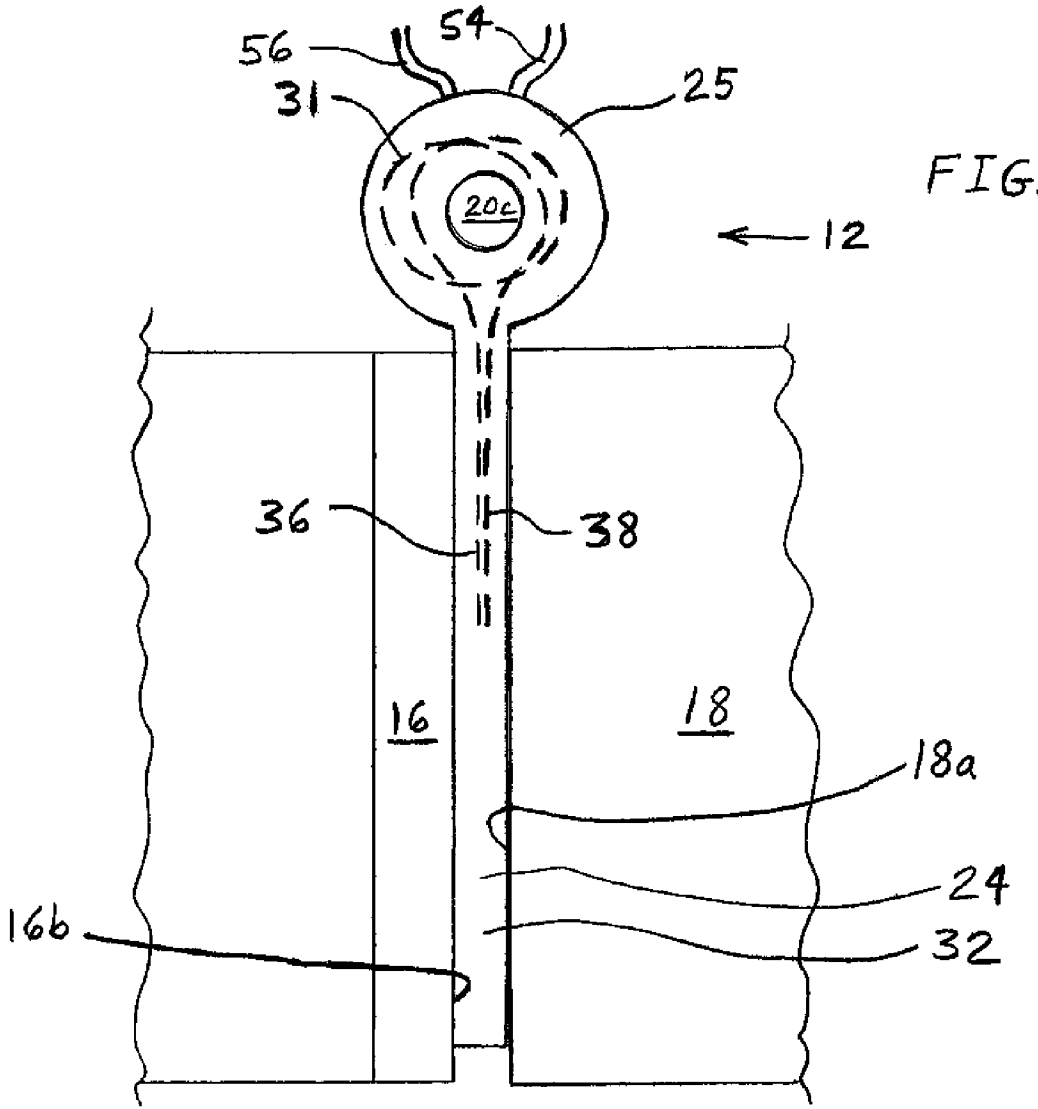
FIG. 4A is a fragmentary top view of the door position detection switch, door frame, and door of FIG. 1 with the door in a closed position.
Figure 4B:
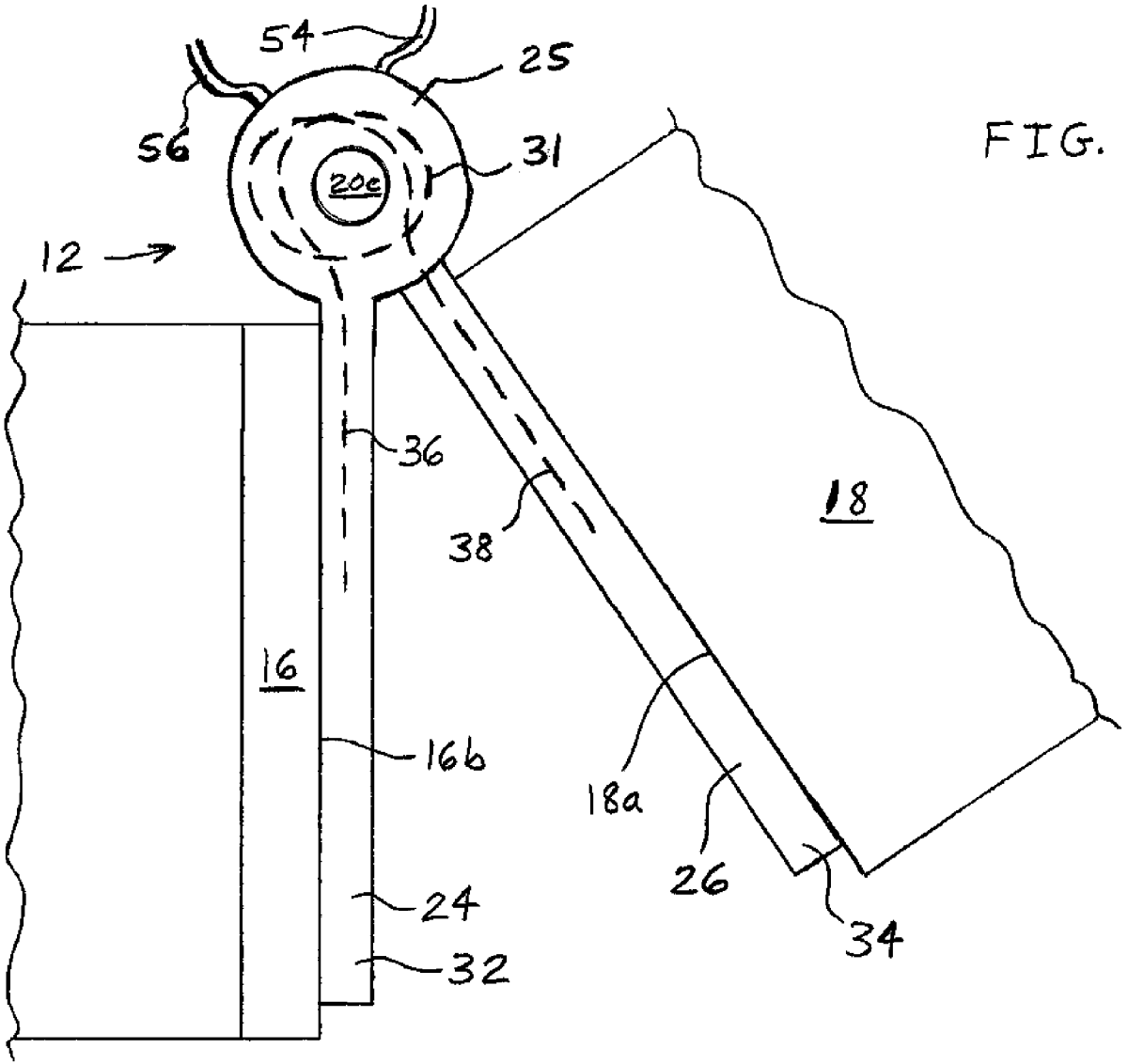
FIG. 4B is a fragmentary top view of the door position detection switch, door frame, and door of FIG. 1 with the door in an open position.

As illustrated in FIGS. 4A and 4B, a coil spring 31 may bias lever arms 32, 34 of fixed portion 24 and rotatable portion 26, respectively, away from each other such that lever arm 32 is biased against door-facing edge surface 16*b* and lever arm 34 is biased against frame-facing edge surface 18*a*. As door 18 is pivoted from the closed position shown in FIGS. 2 and 4A to the open position of FIGS. 1 and 4B, lever arm 32 continues to be biased against door-facing edge surface 16*b* and lever arm 34 continues to be biased against frame-facing edge surface 18*a*.

Stationary portion 24 and rotatable portion 26 of switch 12 may be formed of a plastic material, and spring 31 may be molded therein. Opposite ends 36, 38 of spring 31 may be molded into lever arms 32, 34, respectively. In another embodiment (not shown), arms 32, 34 each include a respective slot in which a respective opposite end 36, 38 of spring 31 is received.

Figure 5:
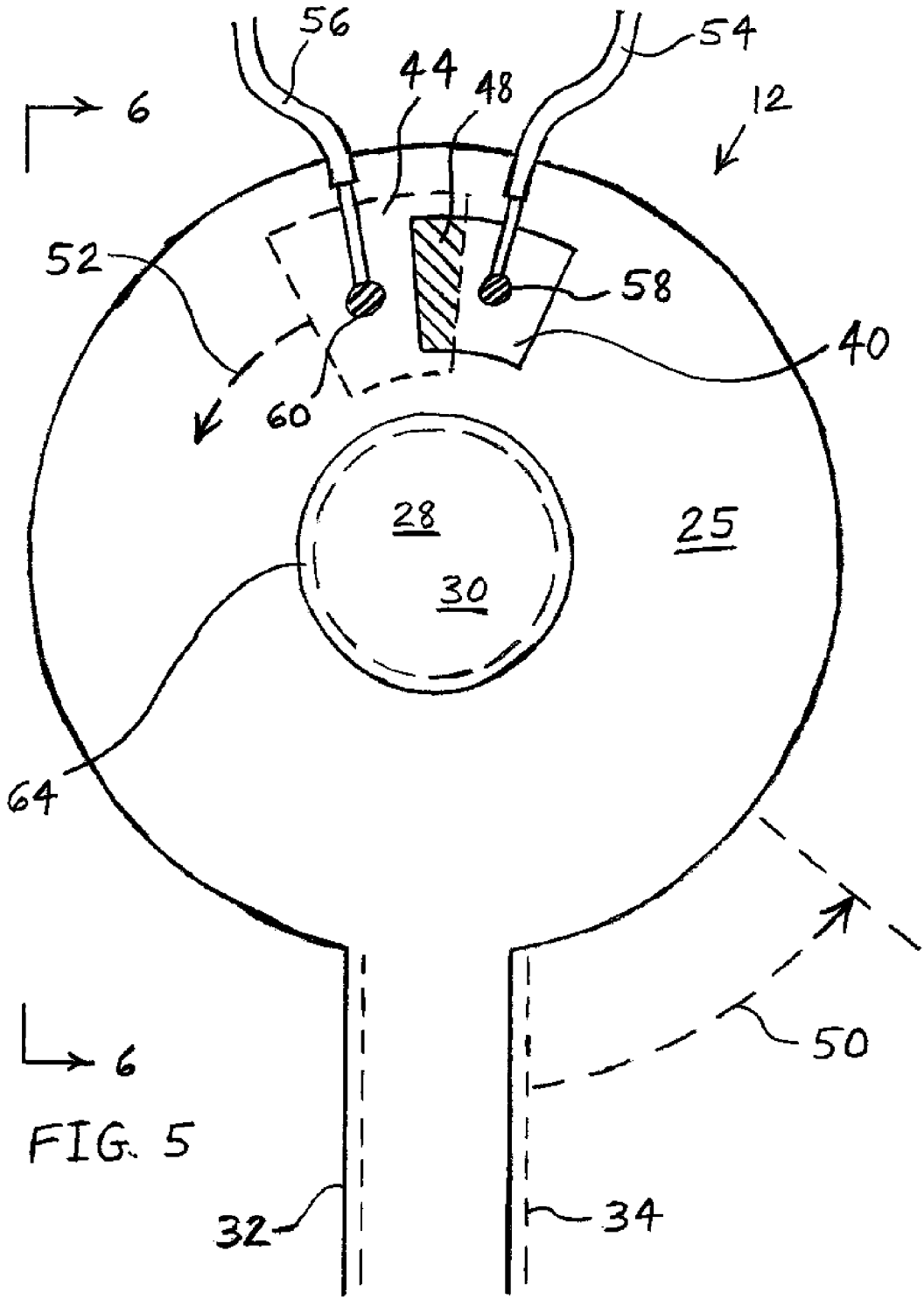
FIG. 5 is a fragmentary top view of the door position detection switch of FIG. 1 illustrating the relative positions of the electrical contacts both when the door is in a closed position and when the door is in an open position.
Figure 6:
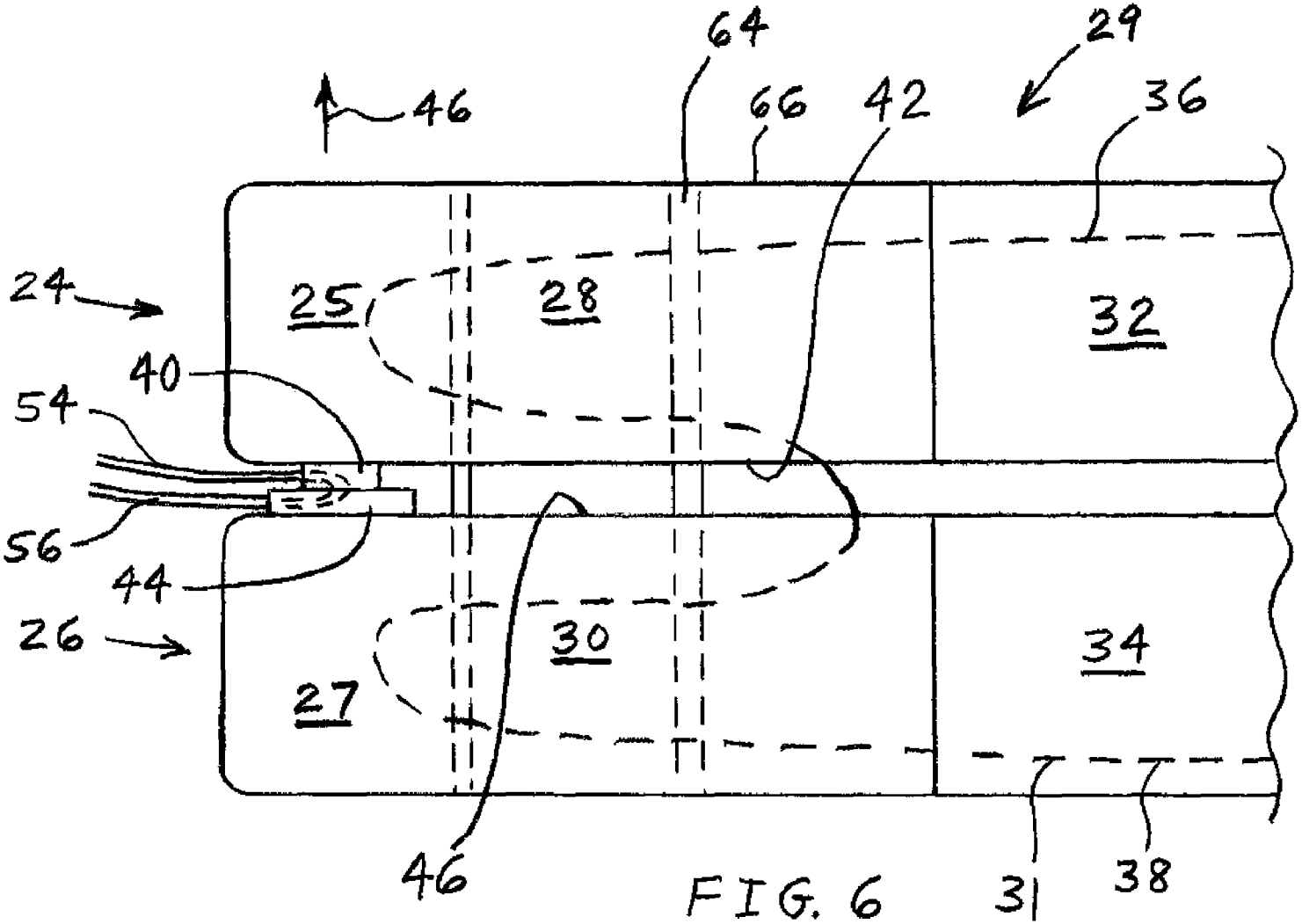
FIG. 6 is a fragmentary side view of the door position detection switch of FIG. 1 along line 6-6 of FIG. 5 with the door is in a closed position.

Referring now to FIG. 5, fixed body 25 includes an electrically conductive contact 40 affixed to, or molded into, a lower surface 42 (FIG. 6) of body 25. Similarly, rotatable body 27 includes an electrically conductive contact 44 affixed to, or molded into, an upper surface 46 of body 27. When door 18 is in the closed position of FIG. 2, and thus arms 32, 34 are substantially parallel as shown in FIG. 5, electrical contact 40 is in engagement with electrical contact 44. More particularly, contact 40 overlaps contact 44 in a vertical direction 46 within area 48.

Stationary portion 24 and rotatable portion 26 may be connected to each other by only spring 31. However, in another embodiment (not shown), bodies 25, 27 may be rotatably coupled together. For instance, lower surface 42 of body 25 may include an arcuate rib that is received in an arcuate groove provided in upper surface 46 of body 27.

Figure 2:
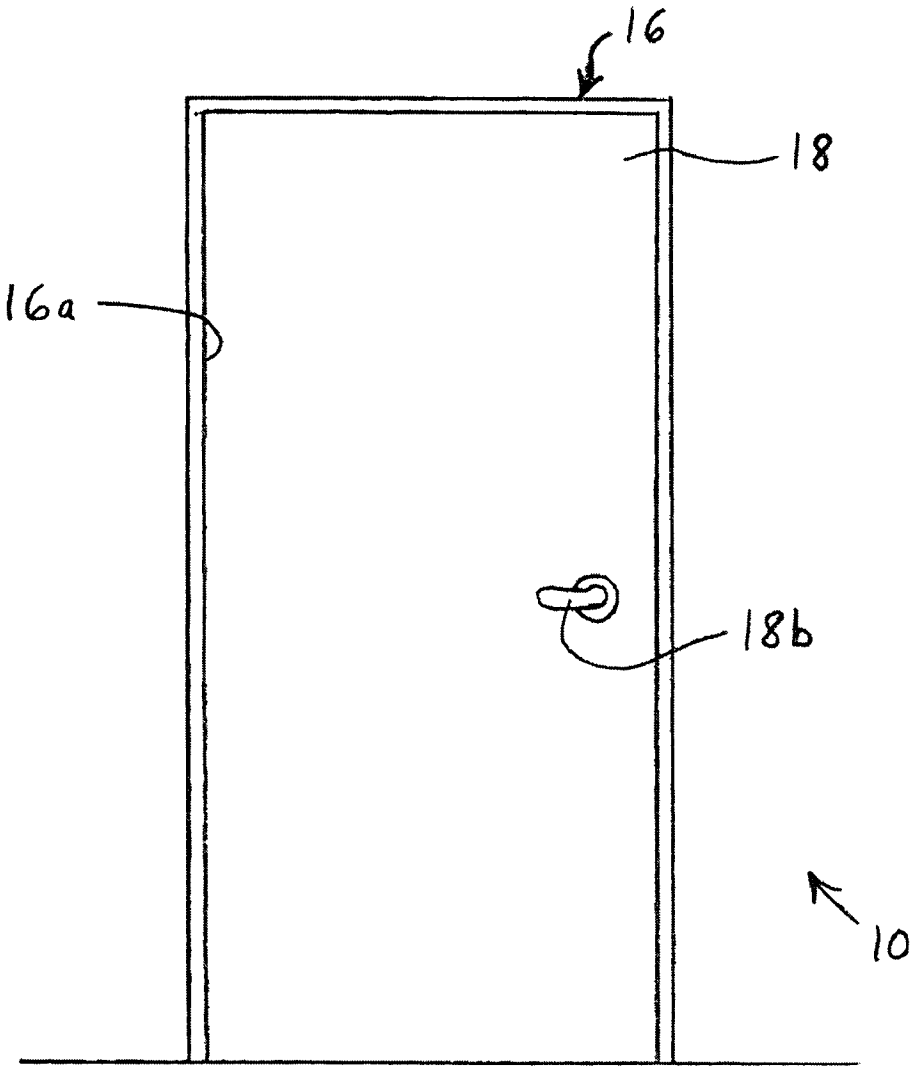
FIG. 2 is a front view of the door position sensing arrangement of FIG. 1 with the door in a closed position.

In operation, as a person moves door 18 from the closed position, shown in FIG. 2, to the open position, shown in FIG.

1, lever arm 34 follows the movement of door 18, as indicated at arrow 50. As arm 34 rotates in direction 50, rotatable body 27 also rotates counterclockwise from the perspective of FIG. 5, and contact 44 rotates out of engagement with contact 40, as indicated by arrow 52. Thus, contact 40 no longer overlaps contact 44 in vertical direction 46.

Electrical conductors, such as wires 54, 56, may be electrically connected to contacts 40, 44, respectively. Wires 54, 56 may be welded to contacts 40, 44, as at 58, 60, respectively. Wires 54, 56 may be electrically connected to an electrical continuity detector 62 (FIG. 1) which may sense and monitor whether or not contacts 40, 44 are electrically connected to, i.e., in contact with, each other.

A cylindrical sleeve 64 may optionally be inserted in through-channel 28 in order to protect bodies 25, 27 from damage that may result from hinge pin 20*c* being inserted therein. An upper end of sleeve 64 may be provided with a lip (not shown) extending in a radially outward direction in order to latch onto an upper surface 66 (FIG. 6) of body 25.

Figure 7:
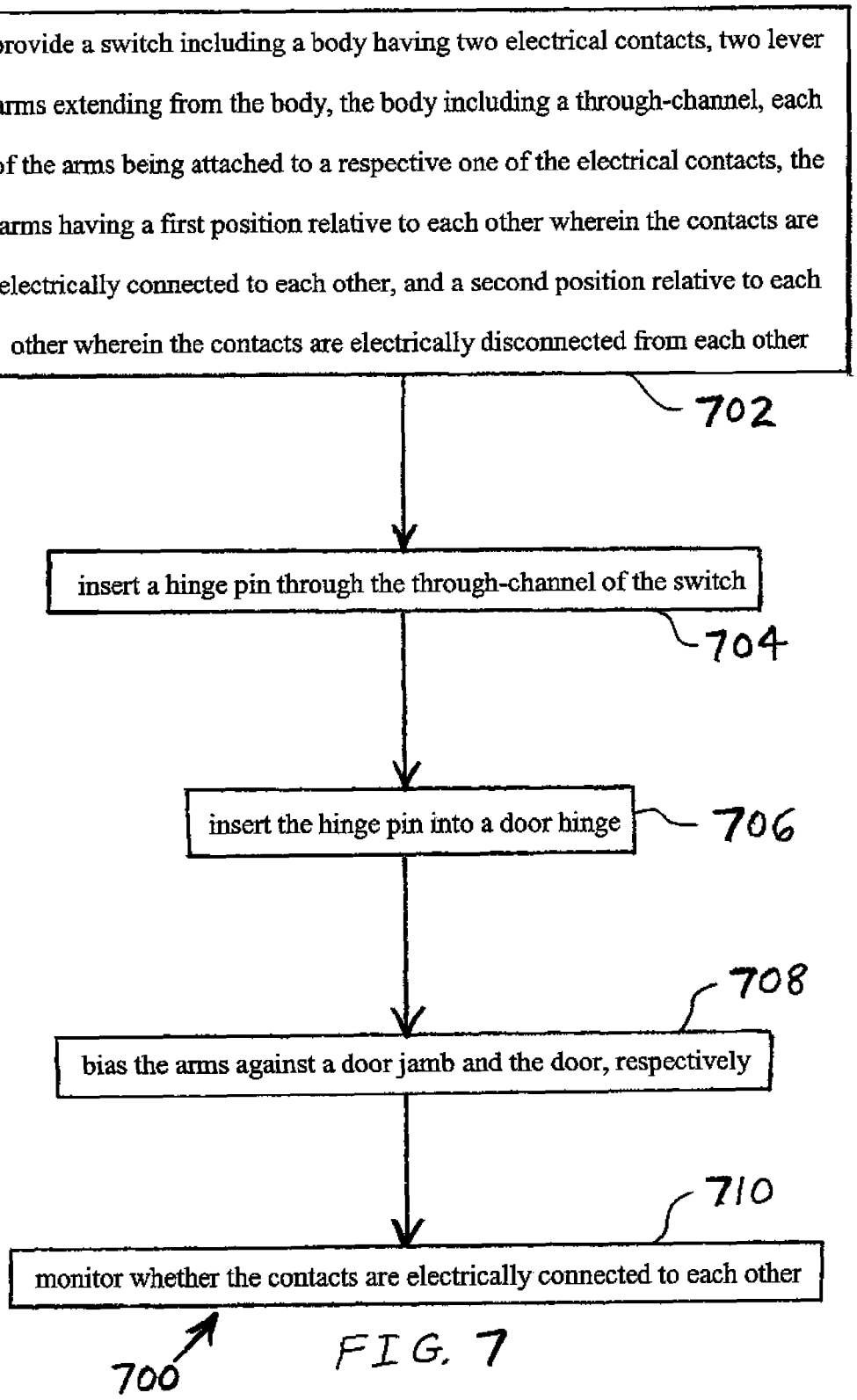
FIG. 7 is a flow chart of one method of the present invention for detecting a position of a door.

One embodiment of a method 700 of the present invention for detecting a position of a door is illustrated in FIG. 7. In a first step 702, a switch is provided including a body having two electrical contacts, two lever arms extending from the body, the body including a through-channel, each of the arms being attached to a respective one of the electrical contacts, the arms having a first position relative to each other wherein the contacts are electrically connected to each other, and a second position relative to each other wherein the contacts are electrically disconnected from each other. As shown in FIG. 1, a switch 12 is provided including a body 29 having two electrical contacts 40, 44, two lever arms 32, 34 extending from the body, the body including a through-channel 28, each of arms 32, 34 being attached to a respective one of electrical contacts 40, 44. Arms 32, 34 have a first position relative to each other, shown in FIG. 4A, wherein contacts 40, 44 are electrically connected to each other, and a second position relative to each other, shown in FIG. 4B, wherein contacts 40, 44 are electrically disconnected from each other.

In a next step 704, a hinge pin is inserted through the through-channel of the switch. That is, hinge pin 20*c* is inserted through through-channel 28 of switch 12.

Next, in step 706, the hinge pin is inserted into a door hinge. For instance, hinge pin 20*c* may be inserted into door hinge 20.

In step 708, the arms are biased against a doorjamb and the door, respectively. More particularly, arms 32, 34 are biased by spring 31 against jamb 16*a* and door 18, respectively.

Finally, in step 710, it is monitored whether the contacts are electrically connected to each other. In the embodiment disclosed above, electrical continuity detector 62 is connected to each of contacts 40, 44 and monitors whether contacts 40, 44 are electrically connected to each other.

Switch 12 has been illustrated herein as including a fixed portion 24 on top and a rotatable portion 26 on the bottom, i.e., engaging and supported by hinge 20. However, it is to be understood that the present invention also encompasses embodiments in which the switch includes a fixed portion on bottom and a rotatable portion on top.

Switch 12 has also been illustrated herein as including electrical contacts 40, 44 that engage each other when door 18 is closed and that do not engage each other when door 18 is open. However, in another embodiment, the electrical contracts may be in engagement with each other when door 18 is open, and may be out of engagement with each other when door 18 is closed.

Electrical contacts 40, 44 are disclosed herein as being used to determine whether the rotatable portion 26 of switch 12 is in a certain position. However, the scope of the present invention encompasses non-contact types of devices that may determine proximity of an object. For instance, the rotatable portion of the switch may include a magnet, and the fixed portion of the switch may include a magnet sensor for determining whether the rotatable portion is in a certain position.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A door position sensing arrangement, comprising:

a door hinge including a fixed part and a rotatable part, the fixed part being attached to a door frame, the rotatable part being attached to a door, the fixed part and the rotatable part conjunctively defining a first through-channel;

a switch including a fixed portion and a rotatable portion rotatably coupled to the fixed portion, the fixed portion having a first electrical contact and the rotatable portion having a second electrical contact, the fixed portion being biased against at least one of the fixed part of the door hinge and the door frame, the rotatable portion being biased against at least one of the rotatable part of the door hinge and the door, the fixed portion and the rotatable portion conjunctively defining a second through-channel aligned with the first through-channel, the fixed portion and the rotatable portion having a first position relative to each other wherein the contacts are electrically connected to each other, and a second position relative to each other wherein the contacts are electrically disconnected from each other, each of the fixed portion and the rotatable portion of the switch having a respective arm extending laterally therefrom, the switch further including a coil spring with two opposite ends, each said end engaging a respective one of the two arms, the arm of the fixed portion being biased by the spring against at least one of the fixed part of the door hinge and the door frame, the arm of the rotatable portion being biased by the spring against at least one of the rotatable part of the door hinge and the door; and a hinge pin extending at least partially through the second through-channel of the switch and at least partially through the first through-channel of the hinge, the coil spring being coiled around the hinge pin.

2. The arrangement of claim 1 wherein each said end is molded into said respective one of the two arms.

3. The arrangement of claim 1 further comprising an electrical continuity detector electrically coupled to the first electrical contact and to the second electrical contact.

4. The arrangement of claim 1 wherein one of the contacts overlaps the other relative to a vertical direction when the arms are in the first position, and the contacts are non-overlapping relative to the vertical direction when the arms are in the second position.

5. The arrangement of claim 1 wherein the switch is connected to the hinge by only the hinge pin.

6. The arrangement of claim 1 wherein one of the fixed portion and the rotatable portion is disposed entirely above an other of the fixed portion and the rotatable portion.

7. The arrangement of claim 1 further comprising a cylindrical sleeve received in the second through-channel, the coil spring being coiled around the sleeve.

8. The arrangement of claim 1 wherein the arm of the rotatable portion is rotatable relative to the arm of the fixed portion in a range of over thirty degrees of rotation in a horizontal direction.

9. A door position sensing arrangement, comprising:

a door hinge including a fixed part and a rotatable part, the fixed part being attached to a door frame, the rotatable part being attached to a door having an open position and a closed position, the fixed part and the rotatable part conjunctively defining a first through-channel;

a switch including a fixed portion and a rotatable portion rotatably coupled to the fixed portion, each of the fixed portion and the rotatable portion of the switch having a respective arm extending laterally therefrom, the arm of the fixed portion being biased against at least one of the fixed part of the door hinge and the door frame, the arm of the rotatable portion being biased against at least one of the rotatable part of the door hinge and the door, the switch further including a spring with two opposite ends, each said end engaging a respective one of the two arms, the fixed portion being biased by the spring against at least one of the fixed part of the door hinge and the door frame, the rotatable portion being biased by the spring against at least one of the rotatable part of the door hinge and the door both when the door is in the open position and when the door is in the closed position, the fixed portion and the rotatable portion conjunctively defining a second through-channel aligned with the first through-channel;

means for sensing a position of the rotatable portion of the switch relative to the fixed portion of the switch; and a hinge pin extending at least partially through the second through-channel of the switch and at least partially through the first through-channel of the hinge.

10. The arrangement of claim 9 wherein each said end is molded into said respective one of the two arms.

11. The arrangement of claim 9 wherein the switch is connected to the hinge by only the hinge pin.

12. The arrangement of claim 9 wherein one of the fixed portion and the rotatable portion is disposed entirely above an other of the fixed portion and the rotatable portion.

13. The arrangement of claim 9 wherein the spring comprises a coil spring coiled around the hinge pin.

14. The arrangement of claim 13 further comprising a cylindrical sleeve received in the second through-channel, the coil spring being coiled around the sleeve.

* * * * *